US010569275B2

(12) United States Patent
Zhu et al.

(10) Patent No.: US 10,569,275 B2
(45) Date of Patent: Feb. 25, 2020

(54) AUTOMATIC CLEANING DEVICE FOR RING HAMMER CRUSHER, AND RING HAMMER CRUSHER

(71) Applicant: HUNAN SUNDY SCIENCE AND TECHNOLOGY CO., LTD., Changsha, Hunan (CN)

(72) Inventors: Xiande Zhu, Changsha (CN); Long Zhong, Changsha (CN)

(73) Assignee: HUNAN SUNDY SCIENCE AND TECHNOLOGY CO., LTD., Hunan (CN)

( * ) Notice: Subject to any disclaimer, the term of this patent is extended or adjusted under 35 U.S.C. 154(b) by 469 days.

(21) Appl. No.: 15/321,734

(22) PCT Filed: Oct. 27, 2015

(86) PCT No.: PCT/CN2015/092964

§ 371 (c)(1),
(2) Date: Dec. 22, 2016

(87) PCT Pub. No.: WO2016/066085

PCT Pub. Date: May 6, 2016

(65) Prior Publication Data

US 2017/0144163 A1 May 25, 2017

(30) Foreign Application Priority Data

Oct. 28, 2014 (CN) ..... 2014 2 0627917 U

(51) Int. Cl.
*B02C 13/26* (2006.01)
*B02C 4/40* (2006.01)
(Continued)

(52) U.S. Cl.
CPC ..... *B02C 13/26* (2013.01); *B02C 4/40* (2013.01); *B02C 13/02* (2013.01); *B02C 23/08* (2013.01); *B08B 1/005* (2013.01); *B08B 1/02* (2013.01)

(58) Field of Classification Search
CPC ..... B02C 13/26; B02C 23/10; B02C 13/02; B02C 23/08; B02C 2013/28618; B02C 2013/28609; B08B 1/002; B08B 1/02
(Continued)

(56) References Cited

U.S. PATENT DOCUMENTS 1,921,914 A * 8/1933 Edman ..... B02C 13/1814 241/60
2,523,004 A * 9/1950 Fowier ..... B02C 13/26 241/187

(Continued)

*Primary Examiner* — Sean M Michalski
(74) *Attorney, Agent, or Firm* — Raymond Y. Chan; David and Raymond Patent Firm

(57) ABSTRACT

An automatic cleaning device for a ring hammer crusher, and a ring hammer crusher having the automatic cleaning device are provided. The automatic cleaning device includes an automatic cleaning assembly at a back side of a feeding opening of a crushing chamber of the ring hammer crusher; the automatic cleaning assembly includes a material meeting disk and a cleaning blocking rod; the material meeting disk is connected to a drive member and is driven by the drive member to rotate, and the cleaning blocking rod is fixed to the crushing chamber and is cooperated with a material meeting surface of the material meeting disk for cleaning. The ring hammer crusher having the automatic cleaning device has a simple structure and convenient operation, thus improving cleaning effect.

12 Claims, 4 Drawing Sheets

(51) Int. Cl.
*B08B 1/00* (2006.01)
*B08B 1/02* (2006.01)
*B02C 13/02* (2006.01)
*B02C 23/08* (2006.01)

(58) Field of Classification Search
USPC ..... 241/166
See application file for complete search history.

(56) References Cited

U.S. PATENT DOCUMENTS 3,587,983 A * 6/1971 Heinrich ..... B02C 13/04 241/64
3,608,840 A * 9/1971 Lange ..... B02C 13/284 241/167
3,759,452 A * 9/1973 Bryant ..... B02C 13/286 241/82
3,761,024 A * 9/1973 Schwey ..... A61L 11/00 241/23
3,770,216 A * 11/1973 Holly ..... A22C 5/00 241/82.1
3,813,048 A * 5/1974 Lehr ..... B02C 18/148 241/224
3,936,004 A * 2/1976 Graf ..... B02C 13/04 241/5
4,166,583 A * 9/1979 Ruckstuhl ..... B02C 13/20 241/154
4,228,964 A * 10/1980 Brady ..... B02C 13/04 241/185.5
4,896,836 A * 1/1990 Mitchell ..... B02C 13/26 209/223.1
5,226,607 A * 7/1993 Karg ..... B02C 18/144 241/166
RE34,458 E * 11/1993 Fahrenholz ..... B02C 17/002 209/234
5,505,390 A * 4/1996 Rodgers ..... B02C 13/06 241/152.2
5,683,044 A * 11/1997 Gueldenpfennig ..... B02C 13/04 241/14
5,875,979 A * 3/1999 Walters ..... B02C 17/007 241/299
6,742,529 B2 * 6/2004 Imai ..... B02C 18/0076 134/184
7,322,538 B1 * 1/2008 Gruhlke ..... B02C 18/14 241/166
2006/0231651 A1 * 10/2006 Evans ..... B02C 18/2216 241/60
2013/0306763 A1 * 11/2013 Carmel ..... A61L 2/07 241/17
2014/0299701 A1 * 10/2014 Zakowski ..... A47J 43/0716 241/166
2015/0197396 A1 * 7/2015 Simons ..... B65G 65/4881 118/255
2017/0232445 A1 * 8/2017 Webb ..... B02C 13/09 241/99

* cited by examiner

AUTOMATIC CLEANING DEVICE FOR RING HAMMER CRUSHER, AND RING HAMMER CRUSHER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a crushing apparatus, and more particularly to a ring hammer crusher and an automatic cleaning device for the ring hammer crusher.

Description of Related Arts

Currently, a traditional crusher generally includes a crushing chamber, a hammerhead, a motor, a principal axis member and a sieve plate. The motor drives the hammerhead to rotate in the crushing chamber and the materials within the crushing chamber are crushed, then an entire crushing operation is completed after the sieving of the sieve plate. During the crushing operation of the traditional crusher, the crushed materials are easily affixed and clogged in the crushing cavity. In order to solve such technical problems, those skilled in the art put forward a lot of solutions. For example, a coal and dust clog cleaning institution for a hammer-type crusher is disclosed in the Chinese application number CN200820139812.4 and an anti-clog and horizontal-type ring hammer crusher is disclosed in the Chinese Patent CN200820054163.8, which a materials scrapping device including a crank and a flat shovel is disclosed. Although the two cleaning apparatus mentioned above play a certain role in cleaning through rotating a hand shank and the crank, scrapping dead corners are remained and the crushers are not completely cleaned as the materials scrapping device is applied uneven forces during the rotating process of the crank. In addition, a horizontal-type ring hammer crusher is disclosed in the Chinese patent CN 201110306725. X. According to this patent, a sweeping and boring rod is provided on an inner wall of a feed inlet and elastic elements are respectively provided on a top and a bottom of the sieve plate. The crushing operation is performed through the sweeping and boring rod and the elastic elements. However, the sweeping and boring rod can only clean up the materials that are in the upper portion of the crushing chamber and scrapping dead corners are still remained.

SUMMARY OF THE PRESENT INVENTION

The invention is advantageous in that it provides a ring hammer crusher and an automatic cleaning device therefor, which has a simple structure and convenient operation, thus improving cleaning effect.

Additional advantages and features of the invention will become apparent from the description which follows, and may be realized by means of the instrumentalities and combinations particular point out in the appended claims.

According to the present invention, the foregoing and other objects and advantages are attained by an automatic cleaning device for a ring hammer crusher, comprising an automatic cleaning assembly provided at a back side of a feeding opening of a crushing chamber of the ring hammer crusher, wherein the automatic cleaning assembly comprises a material meeting disk and a cleaning blocking rod, wherein the material meeting disk is connected to a drive member and is driven by the drive member to rotate, wherein the cleaning blocking rod is fixed to the crushing chamber and is cooperated with a material meeting surface of the material meeting disk for cleaning.

In one embodiment, the material meeting disk is mounted on a turnplate supporting base of the automatic cleaning assembly.

In one embodiment, a shape of the cleaning blocking rod is selected from the group consisting of semi-circular and triangular.

In one embodiment, the cleaning blocking rod is selected from the group consisting of straight rod and curved rod.

In one embodiment, a cleaning brush body is provided on one end of the cleaning blocking rod that is operated with the material meeting disk.

In one embodiment, a number of the cleaning blocking rod is more than two.

According to the present invention, the foregoing and other objects and advantages are also attained by a ring hammer crusher, having a crushing chamber and comprising a ring hammer assembly mounted in the crushing chamber and a sieve assembly, wherein the crushing chamber is provided with a feeding opening on an upper side of the crushing chamber and the sieve assembly is disposed below the ring hammer assembly, wherein an automatic cleaning device is provided on a back side of the feeding opening.

Another advantage of the invention is to provide an automatic cleaning device for a ring hammer crusher, and a ring hammer crusher, which has a simple structure and convenient operation. The automatic cleaning device for the ring hammer crusher has a rotary material meeting disk and a fixed scrapping and sweeping rod so as to have a large effective cleaning area, no cleaning dead corner and an effectively cleaning effect.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
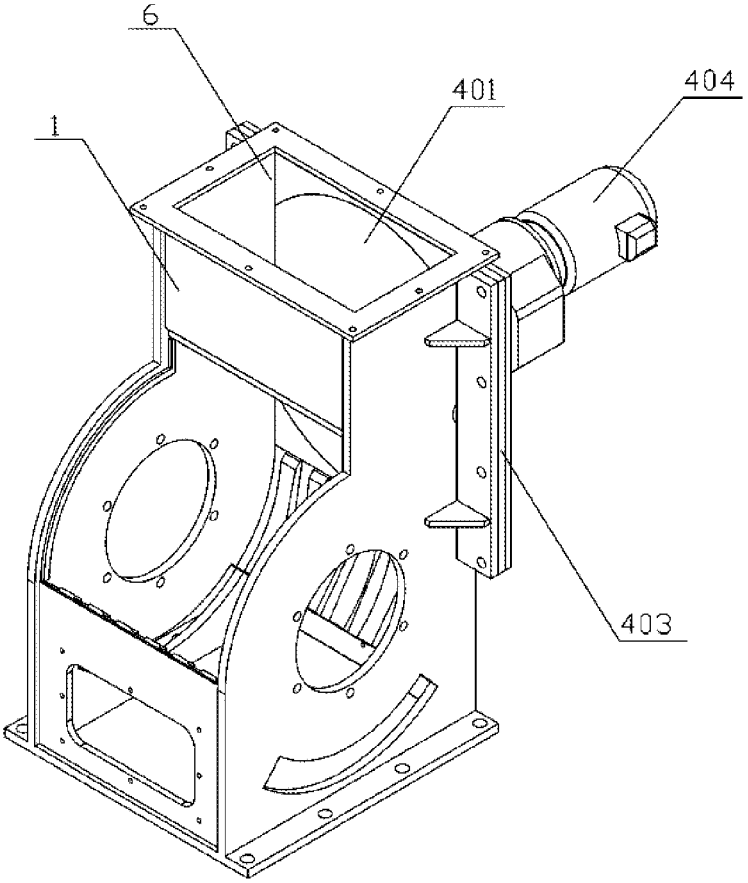
FIG. 1 is a perspective view of an automatic cleaning device according to an embodiment of the present invention.
Figure 2:
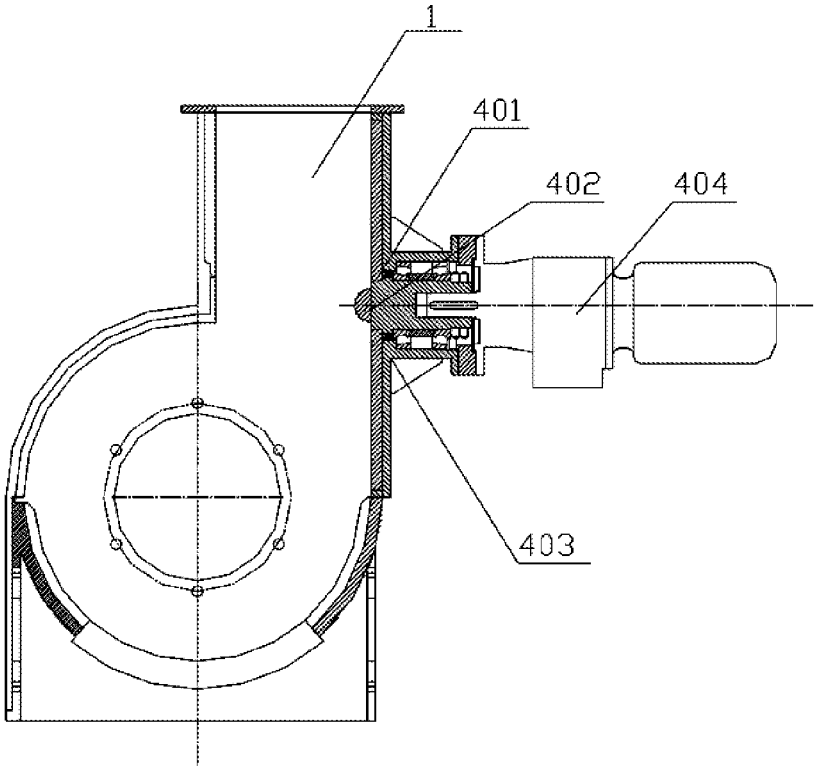
FIG. 2 is a perspective view of the automatic cleaning device according to the above embodiment of the present invention.
Figure 3:
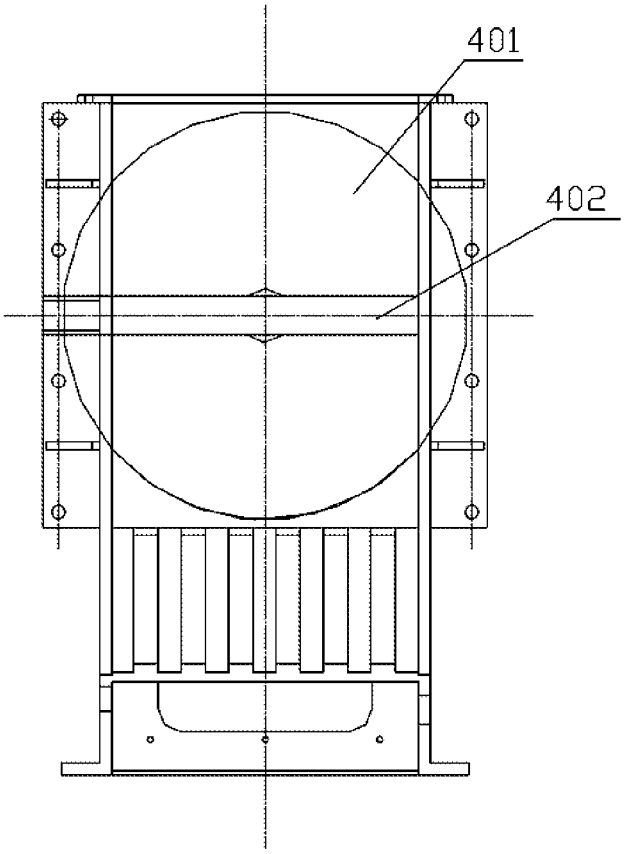
FIG. 3 is a perspective view of the automatic cleaning device according to the above embodiment of the present invention.

Referring to FIG. 1 to FIG. 3 of the drawings, an automatic cleaning device for a ring hammer crusher according to a preferred embodiment is illustrated. The automatic cleaning device comprises an automatic cleaning assembly 4 provided at the back of a feeding opening 6 of a crushing chamber 1 on the ring hammer crusher. The automatic cleaning assembly 4 comprises a material meeting disk 401 and a cleaning blocking rod 402. The material meeting disk 401 is mounted on a turnplate supporting base 403. The material meeting disk 401 is connected to a drive member. The drive member is implied as a gear motor 404. The material meeting disk 401 is driven by the gear motor 404 to rotate. The cleaning blocking rod 402 is fixed on the crushing chamber 1 and is cooperated with a material meeting surface of the material meeting disk 401 for cleaning materials stuck in the material meeting disk 401.

Specifically, shape of the cleaning blocking rod 402 is changeable according to practical needs, such as semi-circular, triangular etc., and the cleaning blocking rod 402 is implied as a straight or curved rod in other embodiment, thereby having a non-material-stick, effort saving and other effects. The length of a gap between the cleaning blocking rod 402 and the material meeting disk 401 is also adjusted according to practical needs.

Furthermore, according to the preferred embodiment of the present invention, a cleaning brush body is provided on one end of the cleaning blocking rod 402 that is operated with the material meeting disk 401 for improving the cleaning effect.

Furthermore, according to the preferred embodiment of the present invention, a plurality of cleaning blocking rods 402 is also provided according to practical needs. The plurality of cleaning blocking rods 402 is suitably distributed according to a material meeting area of the material meeting disk 401 to have an effectively cleaning effect.

Furthermore, according to the preferred embodiment of the present invention, the cleaning areas of the material meeting disk 401 and the cleaning blocking rod 402 cover the entire area of a back plate of the crushing chamber 1. The back plate is a chamber wall in the crushing chamber 1 which is adjacent to the material meeting disk 401 and the cleaning blocking rod 402. The back plate increases the cleaning area and has no cleaning dead corners.

Figure 4:
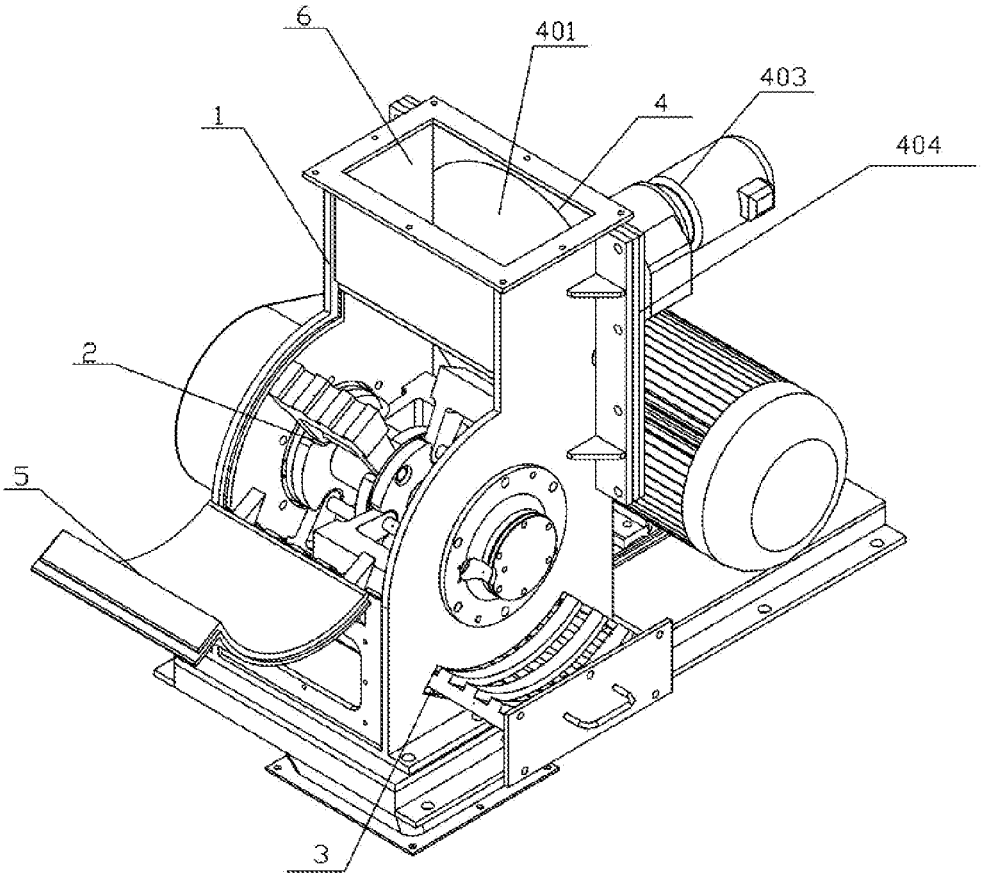
FIG. 4 is a schematic view of a ring hammer crusher according to an embodiment of the present invention.

Referring to FIG. 4 of the drawings, a ring hammer crusher having the above automatic cleaning device according to an embodiment is illustrated. The ring hammer crusher has the crushing chamber 1 and comprises a ring hammer assembly 2 mounted in the crushing chamber 1 and a sieve assembly 3. The crushing chamber 1 is provided with the feeding opening 6 on an upper side of the crushing chamber 1. The crushing chamber 1 is provided with an access door 5 having a big window. The sieve assembly 3 is disposed below the ring hammer assembly 2. The above automatic cleaning device is provided on a back side of the feeding opening 6.

During a crushing operation of the ring hammer crusher, materials enter the crushing chamber 1 via the feeding opening 6 of the ring hammer crusher. The ring hammer assembly 2 is rotated in a high speed to crush the materials. The crushed fine materials enter a lower equipment, and the materials which are not through the holes of the sieve assembly 3 are continued to be crushed under the rotation movement of the ring hammer assembly 2 until the materials are completely through the holes of the sieve assembly 3. During the crushing operation of the ring hammer crusher, a part of the materials fly out along a tangential direction of the ring hammer assembly 2 and hit against the material meeting disk 401 to form a clogging. At this time, the material meeting disk 401 has a uniformly rotation around the central axis under the effect of the gear motor 404, and the fixed cleaning blocking rod 402 scraps and sweeps the materials on the rotating material meeting disk 401 so as to play a role of automatic cleanup.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A ring hammer crusher, comprising:

a crushing chamber having a feeding opening for feeding material to be crushed into said crushing chamber through said feeding opening;

a ring hammer assembly mounted in said crushing chamber and being driven to rotate in a high speed manner for crushing the material in said crushing chamber;

a sieve assembly supported below said ring hammer assembly for sieving the material in a predetermined size; and an automatic cleaning assembly which comprises:

a material meeting disk, having a material meeting surface, rotatably supported at a back wall of said crushing chamber, wherein said ring hammer assembly is operated for crushing the material in said crushing chamber that parts of the material are stuck on said material meeting surface of said material meeting disk;

at least one cleaning blocking rod mounted in said crushing cavity to contact with said material meeting surface of said material meeting disk; and a drive member connected to said material meeting disk to drive said material meeting disk to rotate, wherein when said material disk is driven to rotate, at least one said cleaning blocking rod is arranged for sweeping the material stuck on said material meeting surface of said material meeting disk so as to clean said material meeting disk.

2. The ring hammer crusher, as recited in claim 1, wherein at least one said cleaning blocking rod is replaceable in said crushing chamber.

3. The ring hammer crusher, as recited in claim 1, wherein said automatic cleaning assembly further comprises a turnplate supporting base, wherein said material meeting disk is mounted on said turnplate supporting base.

4. The ring hammer crusher, as recited in claim 1, wherein at least one said cleaning blocking rod is a straight rod or a curved rod.

5. The ring hammer crusher, as recited in claim 1, wherein said automatic cleaning assembly further comprises a cleaning brush body provided at one end of at least one said cleaning blocking rod for brushing said material meeting surface of said material meeting disk.

6. The ring hammer crusher, as recited in claim 1, wherein a shape of at least one said cleaning blocking rod is semi-circular or triangular.

7. An automatic cleaning assembly for a ring hammer crusher which comprises a crushing chamber and a ring hammer assembly to crush material therein, wherein said automatic cleaning assembly comprises:

a material meeting disk, having a material meeting surface, arranged for being rotatably supported at a back wall of the crushing chamber, wherein said material meeting disk is arranged for collecting parts of the material being stuck on said material meeting surface;

at least one cleaning blocking rod arranged for being mounted in the crushing chamber, wherein at least one said cleaning blocking rod contacts with said material meeting surface of said material meeting disk; and a drive member connected to said material meeting disk to drive said material meeting disk to rotate, wherein when said material disk is driven to rotate, at least one said cleaning blocking rod is arranged for sweeping the material stuck on said material meeting surface of said material meeting disk so as to clean said material meeting disk.

8. The automatic cleaning assembly, as recited in claim 7, wherein at least one said cleaning blocking rod is replaceable in the crushing chamber.

9. The automatic cleaning assembly, as recited in claim 7, further comprising a turnplate supporting base, wherein said material meeting disk is mounted on said turnplate supporting base.

10. The automatic cleaning assembly, as recited in claim 7, wherein at least one said cleaning blocking rod is a straight rod or a curved rod.

11. The automatic cleaning assembly, as recited in claim 7, further comprising a cleaning brush body provided at one end of at least one said cleaning blocking rod for brushing said material meeting surface of said material meeting disk.

12. The automatic cleaning assembly, as recited in claim 7, wherein a shape of at least one said cleaning blocking rod is semi-circular or triangular.

* * * * *